US010240267B2

(12) United States Patent
Mutschler et al.

(10) Patent No.: US 10,240,267 B2
(45) Date of Patent: Mar. 26, 2019

(54) NEEDLE CYLINDER AND CIRCULAR KNITTING MACHINE

(71) Applicant: TERROT GMBH, Chemnitz (DE)

(72) Inventors: Thomas Mutschler, Geislingen (DE); Hermann Schmodde, Horb am Neckar (DE); Pierangelo Zola, Cazzago San Martino (IT)

(73) Assignee: Terrot GmbH, Chemnitz (DE)

( * ) Notice: Subject to any disclaimer, the term of this patent is extended or adjusted under 35 U.S.C. 154(b) by 0 days.

(21) Appl. No.: 15/555,989

(22) PCT Filed: Mar. 7, 2016

(86) PCT No.: PCT/IB2016/051286
§ 371 (c)(1),
(2) Date: Sep. 6, 2017

(87) PCT Pub. No.: WO2016/142843
PCT Pub. Date: Sep. 15, 2016

(65) Prior Publication Data

US 2018/0057981 A1 Mar. 1, 2018

(30) Foreign Application Priority Data

Mar. 12, 2015 (DE) ..... 10 2015 103 639

(51) Int. Cl.
*D04B 15/14* (2006.01)
*D04B 15/06* (2006.01)

(52) U.S. Cl.
CPC ..... *D04B 15/14* (2013.01); *D04B 15/06* (2013.01)

(58) Field of Classification Search
CPC ... D04B 1/02; D04B 1/12; D04B 9/00; D04B 9/02; D04B 9/06; D04B 15/06; D04B 15/14; D04B 15/18
(Continued)

(56) References Cited

U.S. PATENT DOCUMENTS 2,662,383 A * 12/1953 Lombardi ..... D04B 9/02 66/107
2,757,527 A * 8/1956 Lawson ..... D04B 15/06 66/107
(Continued)

FOREIGN PATENT DOCUMENTS

EP 2078773 A1 7/2009
EP 2108725 A1 10/2009
(Continued)

*Primary Examiner* — Danny Worrell
(74) *Attorney, Agent, or Firm* — Laurence A. Greenberg; Werner H. Stemer; Ralph E. Locher

(57) ABSTRACT

A needle cylinder of a circular knitting machine includes a cylinder jacket having axial needle channels, knitting needles movable therein and an upper cylinder end for stitch formation having a radial groove between pairs of adjacent needle channels each having an insert forming a stitch formation surface with its insert surface protruding from the groove. Exchangeable, stitch formation surfaces form quickly replaceable inserts. Each insert is a spring lug including a lug foot overlapping the upper cylinder end at the side of the cylinder jacket or the side edge of an outer ring channel in the upper cylinder end and a lug terminal with a terminal part springily engaging behind a counter support projecting at the upper cylinder end at the cylinder's inner side or a side edge of an inner ring channel in the upper cylinder end. A circular knitting machine with the needle cylinder is also provided.

8 Claims, 3 Drawing Sheets

(58) Field of Classification Search
USPC ..... 66/8, 19, 28, 92, 93
See application file for complete search history.

(56) References Cited

U.S. PATENT DOCUMENTS 3,230,742 A * 1/1966 Roedel ..... D04B 15/06 66/107
3,362,195 A * 1/1968 Goisis ..... D04B 7/02 66/106
3,377,823 A * 4/1968 McDonough ..... D04B 15/06 66/107
3,817,058 A * 6/1974 Lombardi ..... D04B 15/10 66/107
4,172,370 A * 10/1979 Safrit ..... D04B 1/02 66/178 R
4,180,993 A * 1/1980 Philip ..... D04B 9/00 66/107
4,314,461 A * 2/1982 Conti ..... D04B 9/02 66/107
4,574,596 A * 3/1986 Engelfried ..... D04B 15/32 66/104
4,576,018 A * 3/1986 Schindele ..... D04B 15/06 66/106
4,838,048 A * 6/1989 Muller ..... D04B 15/68 66/220
4,862,709 A * 9/1989 Engelfried ..... D04B 9/02 66/104
5,048,313 A * 9/1991 Vignoni ..... D04B 15/06 66/107
5,138,848 A * 8/1992 Schnurrer ..... D04B 15/327 66/57
5,195,337 A * 3/1993 Gutschmit ..... D04B 35/28 15/302
5,203,184 A * 4/1993 Lonati ..... D04B 9/06 66/28
5,365,755 A * 11/1994 Schaberle ..... D04B 9/14 66/9 B
5,477,707 A * 12/1995 Renda ..... D04B 1/123 66/107
5,501,085 A * 3/1996 Chen ..... D04B 9/06 66/104
5,816,075 A * 10/1998 Lonati ..... D04B 9/56 66/28
6,223,564 B1 * 5/2001 Lonati ..... D04B 9/56 66/107
6,269,665 B1 * 8/2001 Wang ..... D04B 9/12 66/107
6,568,222 B1 * 5/2003 Morita ..... D04B 15/06 66/106
6,810,694 B2 * 11/2004 Wallis ..... D04B 15/61 66/146
6,840,065 B1 * 1/2005 Wang ..... D04B 15/06 66/107
7,716,955 B2 * 5/2010 Stingel ..... D04B 15/06 66/92
7,793,523 B1 * 9/2010 Plasencia ..... D04B 15/14 66/8
7,827,828 B2 * 11/2010 Pernick ..... D04B 15/06 66/107
7,882,711 B2 * 2/2011 Bianchi ..... D04B 9/56 66/148
8,371,144 B1 * 2/2013 Pai ..... D04B 15/14 66/107
8,484,998 B1 * 7/2013 Pai ..... D04B 15/06 66/107
2001/0022095 A1 * 9/2001 Truffelli ..... D04B 9/56 66/8
2001/0035030 A1 * 11/2001 Eppler ..... D04B 9/06 66/19
2003/0089135 A1 * 5/2003 Sangiacomo ..... D04B 9/06 66/8
2004/0200242 A1 * 10/2004 Willmer ..... D04B 9/025 66/8
2006/0144095 A1 * 7/2006 Frullini ..... D04B 9/02 66/8
2006/0174660 A1 * 8/2006 Maxa ..... D04B 9/56 66/8
2006/0201208 A1 * 9/2006 Miyamoto ..... D04B 15/36 66/8
2008/0034803 A1 * 2/2008 Weihing ..... B65D 85/24 66/8
2008/0264108 A1 * 10/2008 Traenkle ..... D04B 9/025 66/19
2009/0314038 A1 * 12/2009 Lonati ..... D04B 9/02 66/111
2010/0175428 A1 * 7/2010 Lonati ..... D04B 15/06 66/13
2010/0192637 A1 * 8/2010 Lonati ..... D04B 9/06 66/19
2010/0212365 A1 * 8/2010 Jurgens ..... D04B 15/14 66/19
2013/0205836 A1 * 8/2013 Fukui ..... D04B 15/78 66/23
2013/0213093 A1 * 8/2013 Lonati ..... D04B 15/10 66/19
2013/0269394 A1 * 10/2013 Lonati ..... D04B 9/06 66/24
2013/0276482 A1 * 10/2013 Hoffman ..... D04B 15/06 66/28
2014/0260435 A1 * 9/2014 Pernick ..... D04B 15/34 66/107
2016/0348287 A1 * 12/2016 Lonati ..... D04B 15/06
2018/0057981 A1 * 3/2018 Mutschler ..... D04B 15/14

FOREIGN PATENT DOCUMENTS

WO 2014060325 A1 4/2014
WO WO 2014/060325 A1 * 4/2014 ..... D04B 15/14
WO 2015125087 A1 8/2015

* cited by examiner

NEEDLE CYLINDER AND CIRCULAR KNITTING MACHINE

BACKGROUND OF THE INVENTION

Field of the Invention

The present invention relates to a needle cylinder of a circular knitting machine, at whose cylinder jacket, a plurality of needle channels extending in axial cylinder direction with movable knitting needles therein are provided and in whose upper cylinder end provided for the stitch formation, a radial aligned groove is provided between each pair of adjacent needle channels, respectively, in which at least one insert is provided, respectively, which is forming a stitch formation surface with its insert surface protruding from the respective groove. The invention further relates to a circular knitting machine with such a needle cylinder.

Single circular knitting machines comprise a single cylinder needle bed with a plurality of needle channels vertically running side by side at the lateral surface of the needle cylinder, in which knitting needles, for instance latch needles, are moved up and down. For stitch formation, the stitch needles interact with a ring of radially moving strippers, so-called sinkers or lifters, whose movement is matched with the up and down movement of the knitting needles.

However, there are also circular knitting machines without such strippers or with fixed strippers. Such circular knitting machines have bars of solid material between the adjacent knitting needles, respectively, whose surfaces form stitch formation surfaces. On the surfaces of these bars, the yarn, however, continuously rubs at the same spots during the stitch formation process resulting in a high material wear at the surfaces of the bars.

Therefore, hardened cylinder material has been used for the formation of the bars in the state of the art at first. But this has the disadvantage that by hardening the flexibility of the cylinder material is reduced and no optimal sliding surface can be ensured for the yarn by the surface treatment. Moreover, it is necessary to form the bars with a preferably low thickness to provide enough space for the movement of the knitting needles between the bars and the lead-through of the yarn during the stitch formation. This demand, however, is not compatible with the fragility of the hardened bar material.

In further approaches in the state of the art, the bars have been provided of a different material than the cylinder, to say as separate elements being glued into respective cut-out regions at the upper cylinder end. Although such inserts can be provided of more abrasion-resistant material than the cylinder, they are still exposed to the above-mentioned abrasion, which makes it necessary to replace them or even the entire cylinder after a considerable operation period. Such replacement is connected to longer immobilization time of the machine and corresponding production losses.

To overcome this drawback, a needle cylinder of the initially mentioned type with exchangeable inserts has been suggested in the document WO 2014/060325 A1. Thereby, the inserts are provided in radially aligned grooves, which are each provided between a pair of adjacent knitting needle channels, such that the insert surface projecting from the respective groove of the respective insert forms a stitch formation surface.

The inserts described in the document WO 2014/060325 A1 comprise a dovetailed extension, which is inserted in an undercut of a ring channel provided at the upper cylinder end intersecting the radially aligned grooves. The inserts are held in the grooves with the extension inserted in the undercut by a retaining ring running around at the cylinder side with a surface pushing against the insert, wherein the retaining ring is fixed by a screw connection at the cylinder's inner side.

To exchange the inserts, the screw connection has to be therefore unscrewed, the retaining ring to be taken off, the worn insert to be replaced has to be pushed out from the undercut, to be taken out of the groove and a new insert has to be inserted in reverse sequence. This method is relatively complex and thus connected to longer immobilization times of the machine.

SUMMARY OF THE INVENTION

Therefore, the object of the present invention is to provide a needle cylinder of the above-mentioned type and a circular knitting machine with such a needle cylinder with exchangeable, stitch formation surfaces forming inserts, whose replacement is connected to an acceptable time expense.

The object is solved by a needle cylinder of a circular knitting machine, at whose cylinder jacket, a plurality of needle channels extending in axial cylinder direction with movable knitting needles therein are provided and in whose upper cylinder end provided for the stitch formation, a radially aligned groove is provided between each pair of adjacent needle channels, respectively, in which at least one insert is provided, respectively, which is forming a stitch formation surface with its insert surface projecting from the respective groove, wherein the insert is pros vided in form of a spring lug, wherein the spring lug comprises a lug foot overlapping the upper cylinder end at the side of the cylinder jacket or the side edge of an outer ring channel provided in the upper cylinder end and a lug terminal with at least one terminal part springily engages behind a counter support projecting the upper cylinder end at the cylinder's inner side or a side edge of an inner ring channel provided in the upper cylinder end.

The insert formed as spring lug according to the invention can be easily inserted in one of the radially aligned grooves provided at the upper cylinder end and can be clamped on the upper cylinder end. By inserting it into the groove, the insert is fixed in position in circumferential direction of the cylinder. By clamping the insert, it is also fixed in position in radial direction.

The lug foot of the spring lug is either provided around the upper cylinder end at the cylinder jacket side or it is clamped at a side edge not of a cylinder jacket side, but in the surface of the outer ring channel provided in the upper cylinder end. The term "outer ring channel" of the present invention means that the outer ring channel is closer to the outer cylinder respectively cylinder jacket side than to the cylinder's inner side and does not mean that there has to be an inner ring channel necessarily, too.

The lug terminal is either provided around the upper cylinder end at the cylinder's inner side and grabs with a terminal part a counter support formed at the cylinder's inner side, or the lug terminal clamps at a side edge of an inner ring channel provided in the surface of the upper cylinder end. The term "inner ring channel" of the present invention means that the inner ring channel is closer to the cylinder's inner side than to the outer cylinder side respectively cylinder jacket side and does not mean that there has to be an outer ring channel necessarily. In particular embodiments of the present invention, there is neither an outer nor an inner ring channel. In yet other embodiments of the present invention, there is an outer as well as an inner ring channel.

After applying the spring lug into the groove, the insert surface of the spring lug protrudes from the groove and forms a stitch formation surface.

For the replacement of the insert of the needle cylinder according to the invention, only each worn spring lug has to be disconnected from the upper cylinder end. The insert according to the invention holds itself by its own spring tension at the needle cylinder and thus, can be easily mounted and dismounted.

Additional supporting and fixing elements such as the required retaining ring in the circular knitting machine of the document WO 2014/060325 A1, the corresponding screw connection and a position at the cylinder's inner side, at which the retaining ring can be screwed down, or an adhesive fixation of the insert are not necessary in the present invention. Hence, immobilization times of the machines for replacing worn inserts can be minimised in the present invention.

Moreover, the insert according to the invention has the advantage that it can be provided of a material with better abrasion properties than the other cylinder material and can form by its surface a sufficiently large stitch formation surface, over which the yarn is led, with a good glide characteristic. Furthermore, the needle cylinder according to the invention is more cost-effective in the production and the maintenance due to the simple design and the fixation of its inserts.

In an advantageous embodiment of the present invention, the counter support is provided by a nose-shaped projection at the cylinder's inner side end adjacent to the upper cylinder end or at the inner ring channel, wherein at the counter support at the cylinder's inner side or inside the inner ring channel, a bulge for receiving the terminal part, which is grabbing resiliently after the counter support, of the lug terminal is provided. The nose-shaped projection forms a suitable guide for positioning the insert at the edge region present between the surface of the upper cylinder end and the cylinder's inner side or the inner ring channel. The bulge adjacent to the counter support secures the clamping of the lug terminal at the cylinder's inner side or inside the inner ring channel.

Pursuant to a preferred embodiment of the needle cylinder according to the invention, the insert comprises a support area provided in the groove between the lug foot and the lug terminal, wherein between the support area and the lug foot and between the support area and the lug terminal, free cuts are provided in the insert. By the preferably used stamping technology for producing the insert, certain tolerances in the dimensions of the insert, particularly in its inner edge regions, which are led around the upper cylinder end, are unavoidable. Thus, by providing the free cuts, the insert lies fully on the groove bottom with its support area at existing production tolerances, whereby the insert surfaces protruding from the grooves are at one level.

When the lug foot of the needle cylinder according to the invention is provided at the cylinder jacket side, it is particularly advantageous when at the cylinder jacket end bordering the upper cylinder end, a nose-shaped projecting leading for an easier positioning of the lug foot is provided. The remaining area of the cylinder jacket side is reset adverse to the nose-shaped projection in relation to the rib dial of the circular knitting machine.

Furthermore, it has proved advantageous when the insert in the present invention comprises a reset recess area at the cylinder jacket side, between the insert surface forming the stitch formation surface and the lug foot adverse to the end of the stitch formation surface facing a rib dial of the circular knitting machine. The preferably concavely formed recess area reduces the danger of a contact between the latch of the knitting needle and the insert, when the latch needle makes an opening movement after the stitch formation point. Moreover, by this form of the insert, the area, on which dirt can deposit, is reduced.

Thereby, the cleaning of the recess area and/or the lug foot can be done particularly easy by air nozzles directed thereon.

In a particularly advantageous constructive embodiment of the needle cylinder according to the invention, it is provided that the lug foot is formed in shape of a closed round clamp and/or the lug terminal is S-shaped. Hereby, a particularly good hold of the insert at the upper cylinder end is the result.

The object is further solved by a circular knitting machine with a needle cylinder according to the invention.

BRIEF DESCRIPTION OF THE SEVERAL VIEWS OF THE DRAWING

Preferred embodiments of the present invention, their structure, function and advantages are explained in more detail by the following figures, wherein FIG. 1 schematically shows a cross-sectional view of a detail of a circular knitting machine according to the invention with an insert, which overlaps an upper cylinder end at the cylinder jacket side and at the cylinder's inner side, and with a retracted knitting needle.

DESCRIPTION OF THE INVENTION

In the figures, same references indicate same or similar elements, which is why a description of an element, which is done in the following with regard to one figure, applies also for the same reference in other figures.

Figure 1:
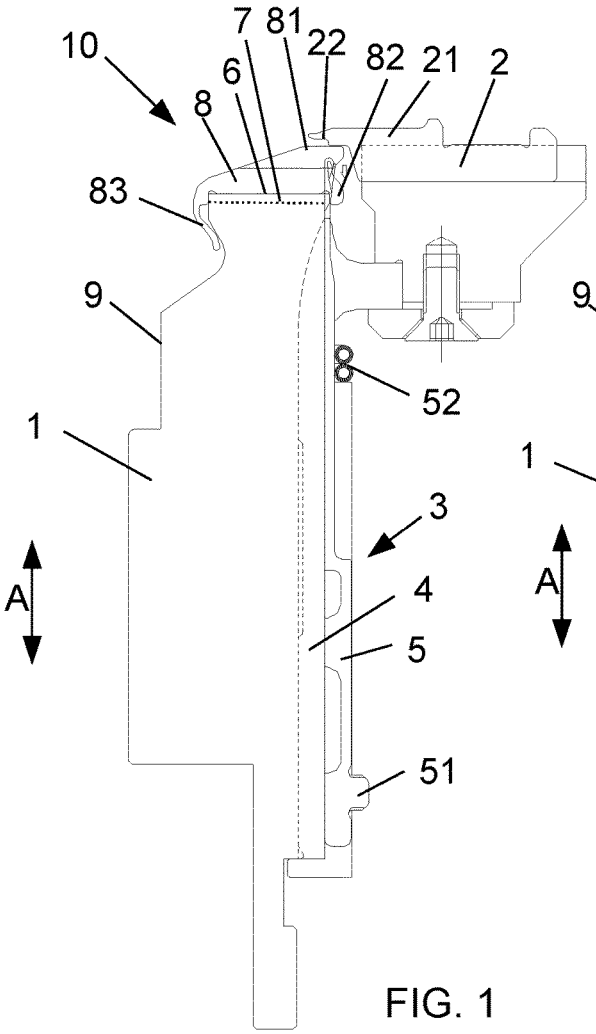
Figure 2:
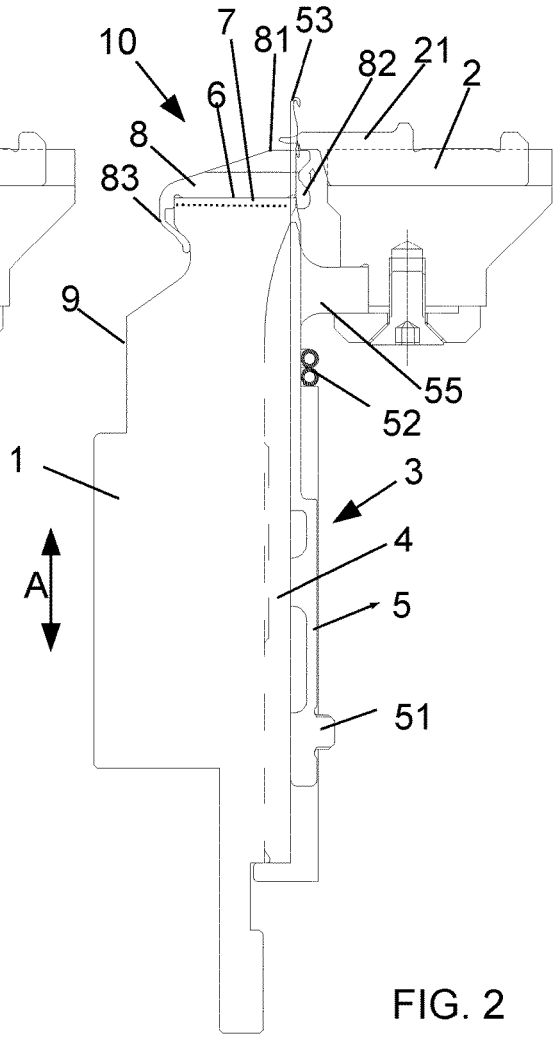
FIG. 2 schematically shows a cross-sectional view of the detail of the circular knitting machine of FIG. 1 with an extended knitting needle.

The FIGS. 1 and 2 schematically show a detail in cut cross-section view of a circular knitting machine 10 according to the invention. The circular knitting machine 10 is a single cylinder circular knitting machine. The diameter of the circular knitting machine 10 is optional.

The circular knitting machine 10 comprises a needle cylinder 1 being aligned upright and a rib dial 2 being transversely aligned to the needle cylinder 1. The needle cylinder 1 comprises a cylinder jacket 3 with a plurality of needle channels 4 spaced-apart in circumferential direction of the needle cylinder 1 and extending in axial cylinder alignment A with movable knitting needles 5 therein, which are here provided as latch needles, but which can also be other stitch forming needles in other embodiments of the present invention. The number of the needle channels 4 as well as the number of the knitting needles 5 therein are dependent from the gauge of the circular knitting machine 10, 10'.

The knitting needles 5 each comprise a needle shank 51, whereby they can be moved upwards and downwards with a lock mechanically coupled at the needle shank 51 not being shown in the present figures. The knitting needles 5 are held in the needle channels 4 by annular springs 52 in the embodiment shown.

In the illustration of FIG. 1, the knitting needle 5 is in a reset position, while the knitting needle 5 in the illustration of FIG. 2 is in an extended position.

The needle cylinder 6 comprises an upper cylinder end 6, being formed as a flattened cylinder upper edge running around the cylinder circumference. By the upper cylinder end 6 is the one cylinder end understood according to the invention from which the heads 53 of the knitting needles 5 protrude during the stitch formation process. In the upper cylinder end 6, radial running grooves 7 are provided, which extend between a pair of needle channels 4, respectively. The grooves 7 basically have a flat, horizontal extending groove base and are straight incisions running through the entire cylinder thickness.

In each of the grooves 7, an insert 8 can be provided, respectively. The insert 8, which is used in the circular knitting machine 10 shown in the FIGS. 1 and 2, is shown enlarged in a perspective view in FIG. 3.

The insert 8 is provided in form of a cross-section flat spring lug. The thickness of the spring lug is slightly smaller than the thickness of the groove 7 so that the insert 8 can be inserted easily but still tightly into the groove 7. The thickness of the insert 8 can be larger in its lower part to be inserted into the groove 7 than in its upper part protruding from the groove 7 in order to ensure a stable guidance of the insert 8 in the groove 7, on the one hand, and to provide enough space for the yarn in the stitch formation process, on the other hand. The thickness of the insert 8, however, can be also constant in all its areas. The radial extension of the insert 8 is larger than the radial extension of the groove 7.

The spring lug comprises a lug foot 82 overlapping the upper cylinder end 6 at the side of the cylinder jacket 3. The lug foot 82 is provided as a closed round clip in the embodiment shown. As can be seen even more clearly in the enlarged illustration of an upper part of the circular knitting machine 10 in FIG. 4, the lug foot 82 encompasses a nose-shaped projecting guidance 31*a* for the lug foot 82 at the end of the cylinder jacket 3 bordering the upper cylinder end 6.

Figure 4:
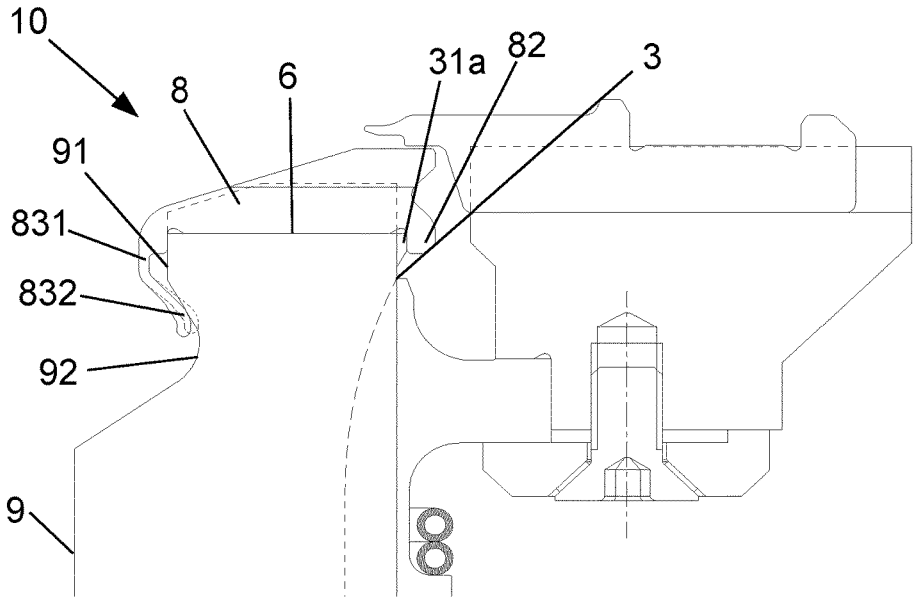
FIG. 4 schematically shows a cut cross-section view of an upper part of the circular knitting machine of the FIGS. 1 and 2 with an illustration of the insert fixed under spring tension.

Furthermore, the insert 8 comprises a lug terminal 83 overlapping an upper cylinder end 6 at the cylinder's inner side 9. The lug terminal 83 is S-shaped in the embodiment shown. The lug terminal 83 initially comprises a convex terminal part 831 projecting from the upper cylinder end 6, and thereupon opens into a concave terminal part 832 protruding to the cylinder's inner side 9. The terminal part 832 forms a spring element, which, as can be seen in FIG. 4, resiliently engages behind the counter-support 91 provided at the cylinder's inner side 9. The counter-support 91 is followed by a projection 92, in which the terminal part 832, which resiliently engages behind the counter-support 91, of the lug terminal 83 is received. In this embodiment of the present invention, the lug terminal 83 is provided at an end of the insert 8 directed to the cylinder's inner side 9.

In other, not-shown embodiments of the present invention, the lug terminal, however, can also be spaced from the end of the insert 8 directed to the cylinder's inner side 9. In this case, an inner annular channel with a, for instance, nose-shaped counter-support intersecting the grooves 7 is provided in the upper cylinder end 6. The lug terminal is inserted into the inner annular channel such that it engages behind a side edge of the inner annular channel provided further away from the cylinder's inner side 9 and thereby engaging behind the counter-support provided at said side edge.

The insert 8 protrudes from the groove 7 and forms a stitch formation surface or stripper surface with its insert surface 81. In the shown embodiment, the insert surface 81 comprises a first insert surface area 811 tilted downwards in the direction of the cylinder's inner side 9 and a second insert surface area 812 extending horizontally.

The insert can comprise wear-reducing coating or treatment, which is at least provided in the insert surface area 812.

Figure 3:
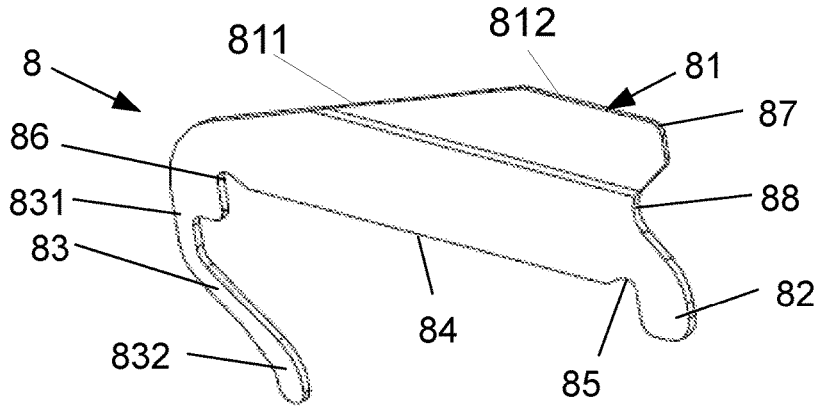
FIG. 3 schematically shows a perspective illustration of the insert used as stripper in the circular knitting machine of the FIGS. 1 and 2 at the upper cylinder end.
Figure 5:
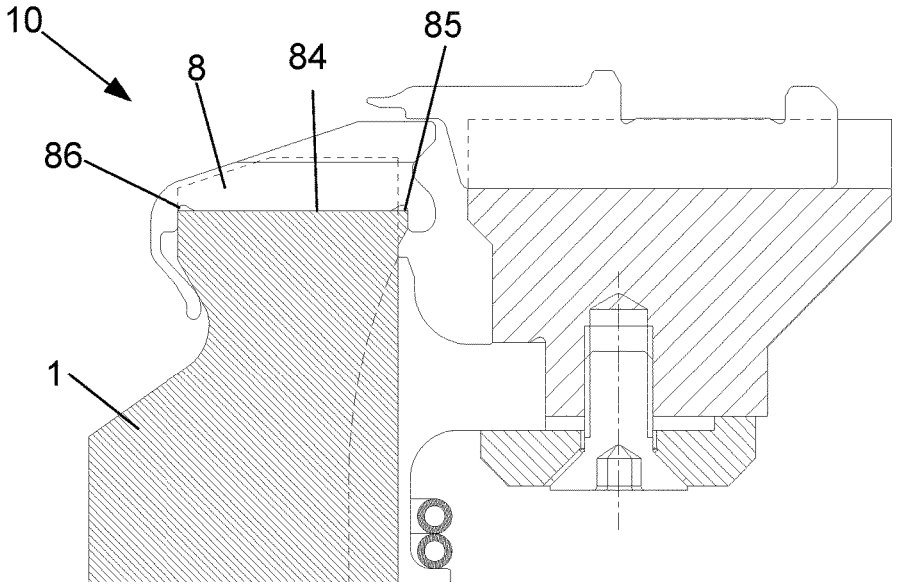
FIG. 5 schematically shows again a cut cross-section view of the part of the circular knitting machine shown in FIG. 4 with different hatching of subcomponents of the circular knitting machine.

As can be well-derived from example in FIG. 3 in relation to FIG. 5, in which the needle cylinder 1 is hatched for better clarity, comprises the insert 8 a support area 84, with which it lays plane on a groove base of the groove 7. Thereby, free cuts 85, 86 in the insert 8 are provided between the support area 84 and the lug foot 82 and between the support area 84 and the lug terminal 83.

The insert 8 comprises at the side of the cylinder jacket 3, between the insert surface 81 forming the stitch formation surface and the lug foot 82, a recess area 88 reset opposite to the end 87 of the stitch formation surface facing the rib dial 2 of the circular knitting machine 10.

Figure 6:
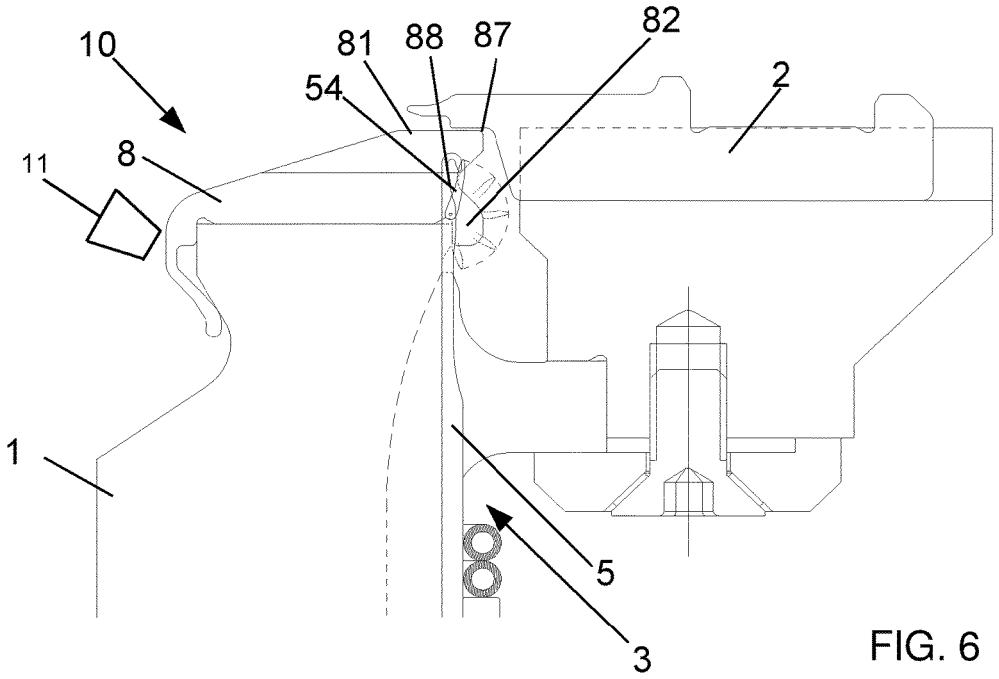
FIG. 6 schematically shows an upper part of the circular knitting machine of the FIGS. 1 and 2, wherein there is a knitting needle with its latch in the area of the insert and air nozzles are directed on said area of the insert.

FIG. 6 schematically shows an upper part of the circular knitting machine of the FIGS. 1 and 2, wherein a knitting needle 5 with its latch 54 is provided in the area of the insert 8 and air nozzles 11 are directed on said area of the insert.

Figure 7:
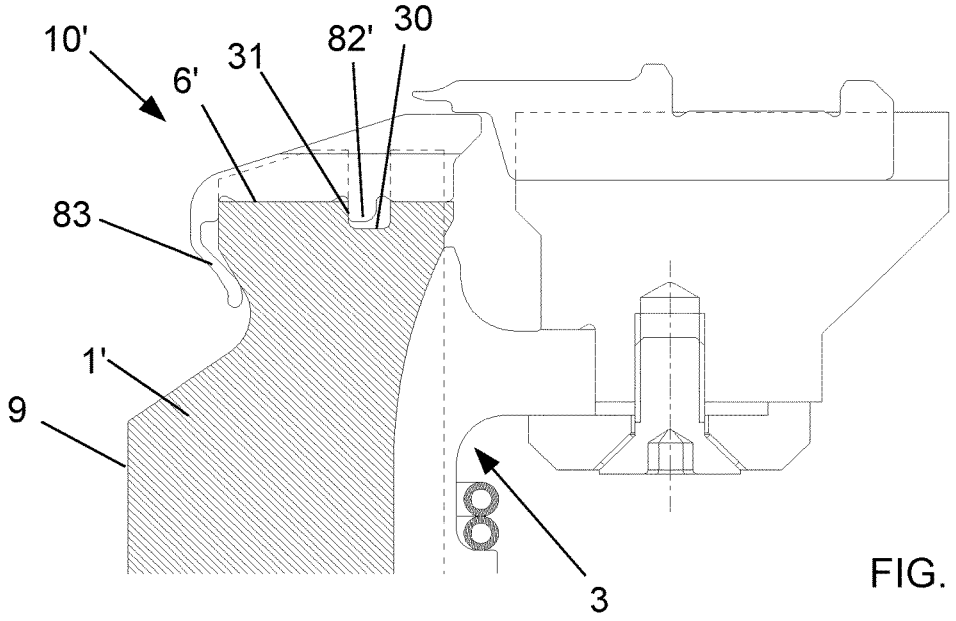
FIG. 7 schematically shows a cut cross-section view of a further embodiment of an upper part of a circular knitting machine according to the invention with an insert, which overlaps an upper cylinder end at a cylinder's inner side and a side edge of an outer ring channel provided in the upper cylinder end.

FIG. 7 schematically shows a cut cross-section of an upper part of another possible embodiment of a circular knitting machine 10' according to the invention.

The circular knitting machine 10' comprises a needle cylinder 1' with a modified upper cylinder end 6' compared to the upper cylinder end 6 from the embodiment of the FIGS. 1 to 6. In the upper cylinder end 6', an outer annular channel 30 running in circumferential direction of the needle cylinder 1' is provided. The outer annular channel 30 intersects the grooves 7.

Furthermore, the circular knitting machine 10' comprises a modified insert 8' compared to the insert 8 of the embodiments of FIGS. 1 to 6. Though the insert 8' comprises, just as the insert 8, a lug terminal 83 overlapping the upper cylinder end 6' at the cylinder's inner side 9 with the above-mentioned features, but does not engage behind the upper cylinder end 6' at the side of the cylinder jacket 3. Instead, the insert 8' comprises a lug foot 82', which engages behind a side edge 31 of the outer annular channel 30 lying further away from the cylinder jacket 3.

The inserts 8, 8' interact with corresponding reciprocating motion elements 21, which are received in horizontal guiding channels in the rib dial 2 of the respective circular knitting machine 10, 10'. The rib dial 2 is coaxially arranged to the needle cylinder 1, 1', respectively, and is fixed to it by a foot 55.

Each movable element 21 has a finger 22 pointing radially in the direction of the cylinder's inner side 9 and runs over the insert surface 81 at its horizontal movement. Thus, in the present invention the inserts 8, 8' forming the stitch formation surfaces take over the function, which is done by movable strippers respectively sinkers in the state of the art. The movable elements 21 hold the stitch near the stitch formation surface, which is provided by the insert surface 81 of the inserts 8, 8', when the knitting needle 5 is lifted so that the stitch is not lifted up by the upward movement of the knitting needle 5, but is pushed in the direction of the needle cylinder center, whereby the contact of the stitch with the knitting needle 5 is maintained.

While a movable element 21 has moved radially to the inside over the needle cylinder 1, 1', a knitting needle 5 moves upwards with the yarn. Thereupon, the finger 22 of the movable element 21 holds the yarn, whereby it is prevented that it is lifted up by the upward movement of the knitting needle. The upward movement of the knitting needle 5 is continued until the stitch is released from the opened latch 54 of the knitting needle.

This results in an increased mechanical stress of the insert surface 81 in comparison to the other areas of the needle cylinder 1, 1'. Hence, if the inserts 8, 8' are worn off with time, they can be removed by simply disconnecting them from the upper cylinder end 6, 6' and can be exchanged for new inserts 8, 8' by simply inserting the new inserts 8, 8' into the grooves 7 and by simply locating the new inserts 8, 8' onto the upper cylinder end 6, 6'.

The above-mentioned embodiments can be combined alternately with each other regarding individual features. The insert 8, 8' can be provided by one or a plurality of interconnected parts and/or by one or a plurality of materials or material combination(s).

The invention claimed is:

1. A needle cylinder of a circular knitting machine, the needle cylinder comprising:

an upper cylinder end for stitch formation, an inner cylinder side having a counter support, a cylinder axis, a cylinder jacket having pairs of adjacent needle channels extending in alignment with said cylinder axis, and a cylinder jacket side;

movable knitting needles disposed in said needle channels;

said upper cylinder end having radially aligned grooves each disposed between a respective pair of adjacent needle channels;

at least one insert disposed in each of said radially aligned grooves, said at least one insert having an insert surface protruding from a respective radially aligned groove and forming a stitch formation surface;

said at least one insert each being a spring lug including a lug foot overlapping said upper cylinder end at said cylinder jacket side or overlapping a side edge of an outer ring channel provided in said upper cylinder end;

said at least one insert each including an S-shaped lug terminal overlapping said upper cylinder end at said inner cylinder side or overlapping a side edge of an inner ring channel in said upper cylinder end; and said S-shaped lug terminal each having at least one terminal part resiliently engaging behind said counter support.

2. The needle cylinder according to claim 1, wherein said counter support is provided by a nose-shaped projection at an end of said inner cylinder side adjoining said upper cylinder end or of said inner ring channel, and said counter support at said inner cylinder side or in said inner ring channel is followed by an indentation for receiving said terminal part of said lug terminal resiliently engaging behind said counter support.

3. The needle cylinder according to claim 1, wherein each insert includes a support area lying planar on a groove base of said groove between said lug foot and said lug terminal, and each insert has respective free cuts provided between said support area and said lug foot and between said support area and said lug terminal.

4. The needle cylinder according to claim 1, wherein said cylinder jacket has an end adjoining said upper cylinder end, and a nose-shaped, projecting guidance for said lug foot provided at said end of said cylinder jacket.

5. The needle cylinder according to claim 1, wherein said insert includes a resetting recess area at said cylinder jacket side between said insert surface forming said stitch formation surface and said lug foot, said recess area being opposite to an end of said stitch formation surface facing a rib dial of the circular knitting machine.

6. The needle cylinder according to claim 5, which further comprises air nozzles directed toward at least one of said recess area or said lug foot.

7. The needle cylinder according to claim 1, wherein said lug foot is a closed, round clip.

8. A circular knitting machine, comprising a needle cylinder according to claim 1.

* * * * *